US009925795B2

(12) United States Patent
Wong et al.

(10) Patent No.: US 9,925,795 B2
(45) Date of Patent: Mar. 27, 2018

(54) MEDIA PROCESSING DEVICE WITH ENHANCED MEDIA AND RIBBON LOADING AND UNLOADING FEATURES

(71) Applicant: ZIH CORP., Lincolnshire, IL (US)

(72) Inventors: Randal Wong, Singapore (SG); Petrica D. Balcan, Thousand Oaks, CA (US); Shu-Hsun Chiang, Hsinchu (TW); Kuan-Ying Lu, Taichung (TW); Chia-Wen Chang, Hsinchu (TW)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 15/490,271

(22) Filed: Apr. 18, 2017

(65) Prior Publication Data

US 2017/0217202 A1 Aug. 3, 2017

Related U.S. Application Data

(63) Continuation of application No. 14/932,664, filed on Nov. 4, 2015, now Pat. No. 9,662,919, which is a continuation of application No. 14/107,574, filed on Dec. 16, 2013, now Pat. No. 9,211,744.

(51) Int. Cl.
*B41J 2/325* (2006.01)

(52) U.S. Cl.
CPC ..... *B41J 2/325* (2013.01)

(58) Field of Classification Search
None
See application file for complete search history.

(56) References Cited

U.S. PATENT DOCUMENTS

| | | | |
|---|---|---|---|
| 4,614,949 | A | 9/1986 | Hakkaku et al. |
| 4,632,585 | A | 12/1986 | Oyamatsu et al. |
| 5,385,416 | A | 1/1995 | Maekawa et al. |
| 6,390,697 | B1 | 5/2002 | O'Mera et al. |
| 6,494,631 | B1 | 12/2002 | Mastinick |

(Continued)

FOREIGN PATENT DOCUMENTS

| | | | |
|---|---|---|---|
| EP | 0410396 | A2 | 1/1991 |
| JP | 60245574 | A | 12/1985 |

(Continued)

OTHER PUBLICATIONS

United States Patent and Trademark Office, "Office Action," issued in connection with U.S. Appl. No. 14/107,574 dated Mar. 2, 2015.

(Continued)

*Primary Examiner* — Lisa M Solomon

(57) ABSTRACT

An example disclosed printer includes a base; a lid hingedly attached to the base movable between a closed position in which the lid is secured to the base, and an open position in which the lid is at least partially separated from the base; a cavity defined between the lid and the base, wherein the cavity is inaccessible when the lid is in the closed position and the cavity is accessible when the lid is in the open position; a ribbon positioning assembly disposed within the cavity that is pivotably attached to at least one of the lid or the base wherein the ribbon positioning assembly is configured to move between a printing position when the lid is in the closed position, and an accessible position when the lid is in the open position, wherein the ribbon positioning assembly comprises a ribbon tensioning mechanism.

12 Claims, 13 Drawing Sheets

(56) References Cited

U.S. PATENT DOCUMENTS

| | | | |
|---|---|---|---|
| 7,871,213 | B2 | 1/2011 | Lodwig et al. |
| 9,211,744 | B2 | 12/2015 | Wong et al. |
| 9,550,380 | B2 | 1/2017 | Balcan et al. |
| 9,662,899 | B2 | 5/2017 | Wong Mun Hon et al. |
| 9,662,919 | B2 | 5/2017 | Wong et al. |
| 2003/0156877 | A1 | 8/2003 | Tischer |
| 2009/0311025 | A1 | 12/2009 | Bandholz et al. |
| 2009/0317161 | A1 | 12/2009 | Vo et al. |

FOREIGN PATENT DOCUMENTS

| | | | |
|---|---|---|---|
| JP | 2003-231286 | A | 8/2003 |
| JP | 2005-305656 | A | 11/2005 |
| JP | 2007-230157 | A | 9/2007 |

OTHER PUBLICATIONS

International Search Report and Written Opinion for corresponding International Patent Application Serial No. PCT/US2014/070541 dated Jul. 7, 2015.

United States Patent and Trademark Office, "Notice of Allowance," issued in connection with U.S. Appl. No. 14/107,574 dated Aug. 18, 2015.

United States Patent and Trademark Office, "Notice of Allowance," issued in connection with U.S. Appl. No. 15/375,376 dated Feb. 28, 2017.

Office Action for Canadian Patent Application No. 2934260 dated May 15, 2017.

Office Action for Japanese Patent Application No. 2016-540972 dated May 29, 2017.

United States Patent and Trademark Office, "Notice of Allowance" issued in connection with U.S. Appl. No. 15/491,577 dated Aug. 14, 2017 (9 pages).

MEDIA PROCESSING DEVICE WITH ENHANCED MEDIA AND RIBBON LOADING AND UNLOADING FEATURES

CROSS-REFERENCE TO RELATED APPLICATIONS

This patent arises from a continuation of U.S. patent application Ser. No. 14/932,664, filed Nov. 4, 2015, which is a continuation of U.S. patent application Ser. No. 14/107,574, filed Dec. 16, 2013, now U.S. Pat. No. 9,211,744, which are both hereby incorporated herein by reference in their entireties.

BACKGROUND OF THE INVENTION

Various embodiments of the invention are directed to printers and other systems for processing media including labels, receipt media, cards, and the like. Applicant has identified a number of deficiencies and problems associated with the manufacture, use, and maintenance of conventional printers. Through applied effort, ingenuity, and innovation, Applicant has solved many of these identified problems by developing a solution that is embodied by the present invention, which is described in detail below.

BRIEF SUMMARY

Various embodiments of the present invention are directed to a system and method for loading and unloading consumable supplies of a printer, and more particularly, to systems and methods for providing a compact form factor printer which provides convenient access to the replaceable components of the printer.

A printer according to an example embodiment of the present invention may include a base and a lid hingedly attached to the base, moveable between a closed position in which the lid is secured to the base, and an open position. A cavity may be defined between the lid and the base, where the cavity is inaccessible when the lid is in the closed position and the cavity is accessible when the lid is in the open position. The printer may include a ribbon positioning assembly disposed within the cavity that is pivotably attached to at least one of the lid or the base, where the ribbon positioning assembly is configured to move between a printing position when the lid is in the closed position and an accessible position when the lid is in the open position. A printhead assembly may be attached to the lid. The printhead assembly may be pivotably attached to the lid. The printhead assembly may move to a disengaged position relative to the ribbon positioning assembly in response to the lid moving to the open position. The printhead may move to an engaged position relative to the ribbon positioning assembly in response to the lid moving to the closed position. The printhead assembly may be disposed at a first angle relative to the lid in the disengaged position, and the printhead assembly may be disposed at a second angle relative to the lid, different from the first angle, in the engaged position. The base may include a platen roller, and in response to the lid being moved from the open position to the closed position, a printhead of the printhead assembly may be brought into engagement with the platen roller.

According to some embodiments, the ribbon positioning assembly may be interchangeable between a ribbon cartridge receiving frame sub-assembly non-ribbon cartridge ribbon receiving frame sub-assembly. The ribbon positioning assembly may be configured to receive a ribbon cartridge. A ribbon feed path may be defined proximate the ribbon positioning assembly between a first spool and a second spool of the ribbon cartridge, and the printhead assembly may be driven between the first spool and the second spool in response to the lid moving from an open position to a closed position. The printhead may engage the ribbon as the printhead assembly is driven between the first spool and the second spool, and the printhead may drive the ribbon to a ribbon printing path.

According to some embodiments, the base may define a media receiving area configured to be accessible when the lid is in the open position and inaccessible when the lid is in the closed position. When the lid is in the open position and the ribbon positioning assembly in the accessible position, a center of gravity of the printer may be defined proximate the base of the printer relative to the lid and the ribbon positioning assembly. The lid may be hingedly attached to the base proximate a back of the printer and the ribbon positioning assembly may be pivotably attached to at least one of the lid or the base proximate the back of the printer. The center of gravity, in response to the lid being in the open position and the ribbon positioning assembly in the accessible position, may be defined proximate the base of the printer between about one-third the distance from the back of the printer to a front of the printer and about two-thirds the distance from the back of the printer to the front of the printer. The lid may be moved at least ninety degrees about a hinge in response to the lid being moved from the closed position to the open position.

Some embodiments of the present invention may provide a printer including a base and a lid hingedly attached to the base that is moveable between a closed position in which the lid is secured to the base, and an open position in which the lid is at least partially separated from the base. The lid and base may define a cavity therebetween, where the cavity is inaccessible when the lid is in the closed position, and the cavity is accessible when the lid is in the open position. A ribbon positioning assembly may be disposed within the cavity and pivotably attached to at least one of the lid or the base, where the ribbon positioning assembly may be configured to move between a printing position when the lid is in the closed position, and an accessible position when the lid is in the open position, where the ribbon positioning assembly includes a ribbon tension mechanism. The ribbon positioning assembly may be configured to receive therein a ribbon cartridge including a first spool and a second spool with a ribbon extending therebetween, where the ribbon tensioning mechanism may be configured to apply tension to the ribbon between the first spool and the second spool. The ribbon tensioning mechanism may be configured to maintain tension on the ribbon in response to the lid being moved from the closed position to the open position.

Embodiments may further include a printhead assembly pivotably coupled to the lid, where a printhead of the printhead assembly is disengaged from the ribbon in response to the lid being moved from the closed position to the open position. The printhead of the printhead assembly may be engaged with the ribbon in response to the lid being moved from the open position to the closed position. The printhead assembly may be disposed at a first angle relative to the lid in response to the lid being in an open position, and the printhead assembly may be disposed at a second angle relative to the lid, different from the first angle, in response to the lid being in a closed position. The ribbon printing assembly may be configured to receive therein a ribbon cartridge including a first spool and a second spool, with a ribbon extending therebetween, The printer may further include a printhead assembly pivotably coupled to the lid where in response to the lid being moved from the open position to the closed position, the printhead assembly is driven between the first spool and the second spool. The printhead assembly may include a printhead, and in response to the lid moving from the open position to the closed position, the printhead may move into a position in which the second spool is positioned substantially between the printhead and the lid. The printhead assembly may further include a convex deflector assembly and the printhead assembly may define a print line where the printhead engages the platen roller. The convex deflector assembly may be positioned upstream of the print line relative to a media feed path. The convex deflector assembly applies tension across a width of the ribbon, parallel to the print line to remove wrinkles from the ribbon as it moves along a ribbon printing path.

According to another example embodiment of the present invention, a ribbon cartridge is provided that includes a first spool housing configured to receive a first spool, a second spool housing configured to receive a second spool, and at least one frame member extending between the first spool housing and the second spool housing. A locking feature defining a locked position and an unlocked position adapted to lock the ribbon cartridge within a ribbon positioning assembly may also be provided. The ribbon cartridge may further include a spool lock, where the spool lock is configured to engage at least one of the first spool or the second spool in response to the ribbon cartridge not being received within a ribbon positioning assembly. The spool lock may be configured to disengage the at least one of the first spool or the second spool in response to the ribbon cartridge being received within a ribbon positioning assembly. The spool lock may be configured to engage both the first spool and the second spool in response to the ribbon cartridge not being received within a ribbon positioning assembly, and the spool lock may be configured to maintain a tension of a ribbon extending between the first spool and the second spool when the spool lock is engaged with the first spool and the second spool. The first spool may be a ribbon supply spool and the second spool may be a ribbon take-up spool, where a radio frequency identification chip may be disposed proximate the take-up spool.

According to some embodiments, the frame member extending between the first spool housing and the second spool housing may define a recess, where the recess of the frame member is defined by an area of the frame member that is narrower than a majority of the frame member. The frame member may include additional structural reinforcement proximate the recess relative to the majority of the frame member.

Another example embodiment of the present invention may provide a printer that includes a base and a lid hingedly attached to the base and moveable between a closed position in which the lid is secured to the base, and an open position. A cavity may be defined between the lid and the base, where the cavity may be inaccessible when the lid is in the closed position, and the cavity is accessible when the lid is in the open position. The printer may further include a ribbon positioning assembly disposed within the cavity that is pivotably attached to at least one of the lid or the base, where the ribbon positioning assembly may be configured to move between a printing position when the lid is in the closed position, and an accessible position when the lid is in the open position, where the ribbon positioning assembly includes a first pair of guide channels configured to receive therein a ribbon cartridge, and a second pair of guide channels. The printer may include a printhead assembly attached to the lid, where the printhead assembly engages the second pair of guide channels and translates within the guide channels in response to the lid being moved between the closed position and the open position.

According to some embodiments, the printhead assembly may be pivotably attached to the lid. The printhead assembly may move along the second pair of guide channels to a disengaged position relative to the ribbon positioning assembly in response to the lid moving to the open position, and the printhead may move along the second pair of guide channels of an engaged position relative to the ribbon positioning assembly in response to the lid moving to the closed position. The printhead assembly may be disposed at a first angle relative to the lid in the disengaged position, and the printhead assembly may be disposed at a second angle relative to the lid, different from the first angle, in the engaged position. The base may include a platen roller, and in response to the lid being moved from the open position to the closed position, a printhead of the printhead assembly may be brought into engagement with the platen roller.

According to some embodiments, the printer may include a ribbon feed path defined proximate the ribbon positioning assembly between a first spool and a second spool of the ribbon cartridge, and the printhead assembly may be driven between the first spool and the second spool in response to the lid moving from an open position to a closed position. The printhead may engage the ribbon as the printhead assembly is driven between the first spool and the second spool.

According to another embodiment of the present invention, a printer may be provided including a base, a platen assembly supported proximate the base, a lid hingedly attached to the base movable between a closed position in which the lid is secured to the base, and an open position, and a ribbon positioning assembly. The ribbon positioning assembly may be disposed within the cavity and may be pivotably attached to at least one of the lid or the base, where the ribbon positioning assembly is configured to move between a printing position when the lid is in the closed position, and an accessible position when the lid is in the open position, where a media access gap is defined between the ribbon positioning assembly and the platen assembly for accessing a media supply. The media access gap may be sized to receive there through a supply of media. In response to the ribbon positioning assembly being moved to the closed position, the media access gap may be closed to define a media feed path along which media travels during printing. In response to the ribbon positioning assembly being moved to the closed position, at least a portion of the media and at least a portion of the ribbon are captured between a printhead and the platen assembly.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Printers and media processing devices may be configured to print and/or encode media drawn from a roll or spool. Such media may include a web supporting a plurality of individually cut media components, such as adhesive-backed and carrier-supported labels, or the media may be a continuous web such as a spool of linerless label media or direct thermal media. Printers process (e.g., print, encode, etc.) the media by drawing the media from the spool and routing the media proximate various processing components (e.g., printhead, RFID reader/encoder, magnetic stripe reader/encoder etc.). Processing the media from a spool may facilitate a continuous or batch printing process.

From time to time, printers exhaust the available supply of media such that a user must replace the media supply spool. Other consumables such as ribbon or ribbon cartridges, printheads, and the like must also be periodically replaced. Replacing consumable components of a printer can often be complex and arduous, with the time to replace such components resulting in costly downtime of the media processing device. Replacement of consumable components can be even more difficult for media processing devices of relatively small form factors, such as desktop or mobile printers, as the components are generally tightly packaged into a relatively small housing. As such, it may be desirable for a media processing device to provide easy access to the consumable components therein to facilitate relatively quick and easy replacement of consumable components, particularly for a media processing device including a small form factor.

Embodiments of the present invention are directed to an improved media processing device that is structured to enhance user serviceability and simplify replacement of consumable components. Such embodiments are configured to provide these advantages while maintaining a compact size.

Figure 1:
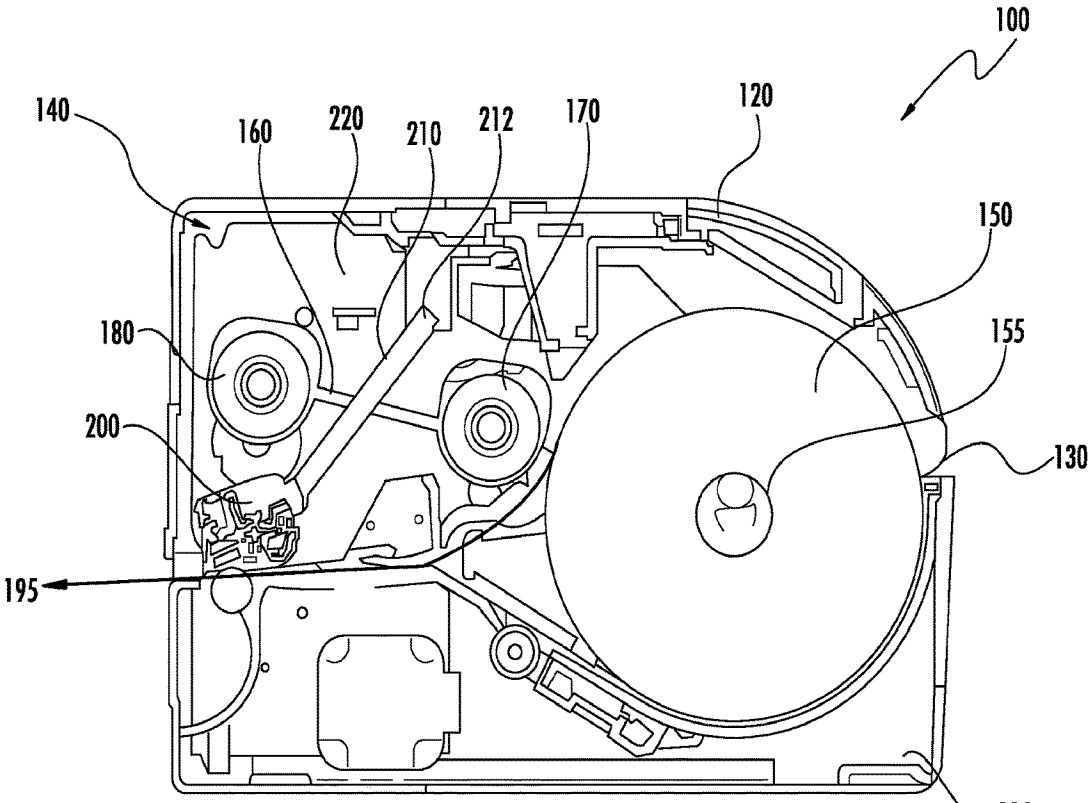
FIG. 1 illustrates a cross-section view of a media processing device according to example embodiments of the present invention.

FIG. 1 illustrates a printer or processing device according to example embodiments of the present invention. The illustrated embodiment depicts a cross-section of a media processing device 100 in profile, as viewed perpendicularly to a media feed path 195. While the illustrated embodiments and description provided herein are directed primarily to a printing device, other media processing devices such as media encoders, label applicators, or laminators, may benefit from the mechanisms described. Further, an example embodiment of the present invention may provide printing, encoding, and/or laminating functionality in a single device.

The printer 100 of FIG. 1 includes a housing with a base 110 and a lid 120. According to the illustrated embodiment, the lid 120 and the base 110 are arranged in a closed position in which the lid 120 is secured to the base 110. The lid 120 may be hingedly attached to the base 110 along a hinge 130, which may be located, for example, along a back side of the printer. According to some embodiments, a cavity 140 may be defined between the lid 120 and the base 110. The cavity may be inaccessible when the lid 120 is closed relative to the base 110 as shown in FIG. 1; however, the cavity 140 may be accessible to a user when the lid 120 is moved to an open position relative to the base 110 as will be described further below.

Figure 2:
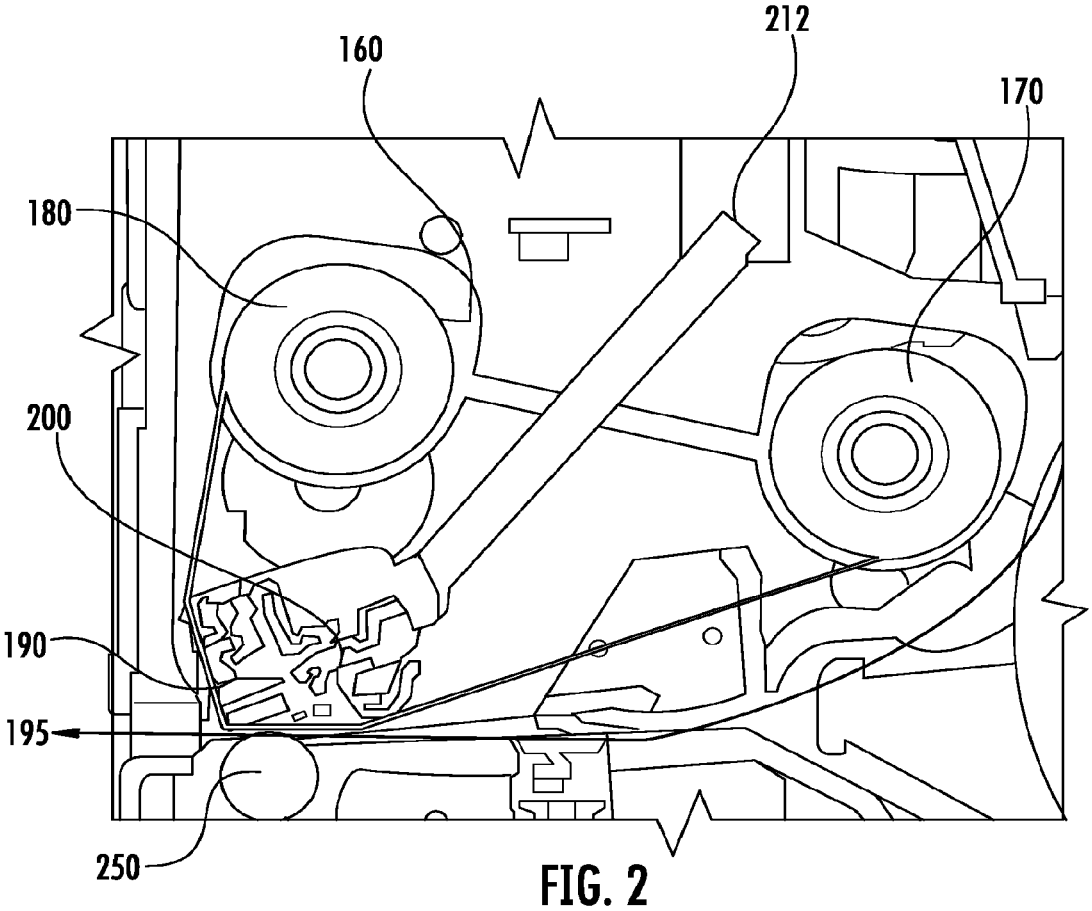
FIG. 2 illustrates a detail view of a ribbon cartridge and a printhead engaged with a ribbon according to an example embodiment of the present invention.

Within the cavity 140 of example embodiments may be a media receiving area in which a spool of media 150 may be received. A media spool 150 may be received, for example, on a media spindle 155 as shown in FIG. 1. While the illustrated embodiment of FIG. 1 includes a spool of continuous media, embodiments of the invention may also be configured to receive fan-fold media stacks, a stack or cartridge of individual media units (e.g., RFID cards), or the like. The cavity 140 may also be configured to receive a ribbon or ribbon cartridge therein. The embodiment of FIG. 1 illustrates a ribbon cartridge 160 that includes a first spool 170 (e.g., a media supply spool) and a second spool 180 (e.g., a media take-up spool). A ribbon may extend from the first spool 170, around a printhead 200 along a ribbon printing path 190 as shown in FIG. 2, which is a detail view of the printhead 200 and ribbon cartridge 160. The ribbon printing path 190 may extend between the printhead 200 and a platen roller 250 and a media feed path may extend from a media supply (e.g., media supply spool 150) along arrow 195 between the printhead 200 and the platen roller 250.

Referring back to FIG. 1, the printhead 200 may be coupled to printhead assembly 210 which extends from the lid 120 and may be pivotably coupled to the lid (e.g., at 212) as will be described further below. Embodiments of the present invention may further include a ribbon positioning assembly 220 disposed within cavity 140, where the ribbon positioning assembly is configured to pivot relative to the base 110 in general (but not necessarily absolute) concert with the lid 120 in order to provide access to the ribbon cartridge 160 and media feed path 195 as detailed further below. While embodiments illustrated herein include a ribbon positioning assembly 220 coupled to the lid 120 such that the ribbon position assembly 220 moves to an accessible position in response to the lid 120 moving to the open position, alternative embodiments may include a ribbon positioning assembly 220 that is decoupled from the lid and is movable independently between a closed, printing position, and an open, accessible position.

Figure 3:
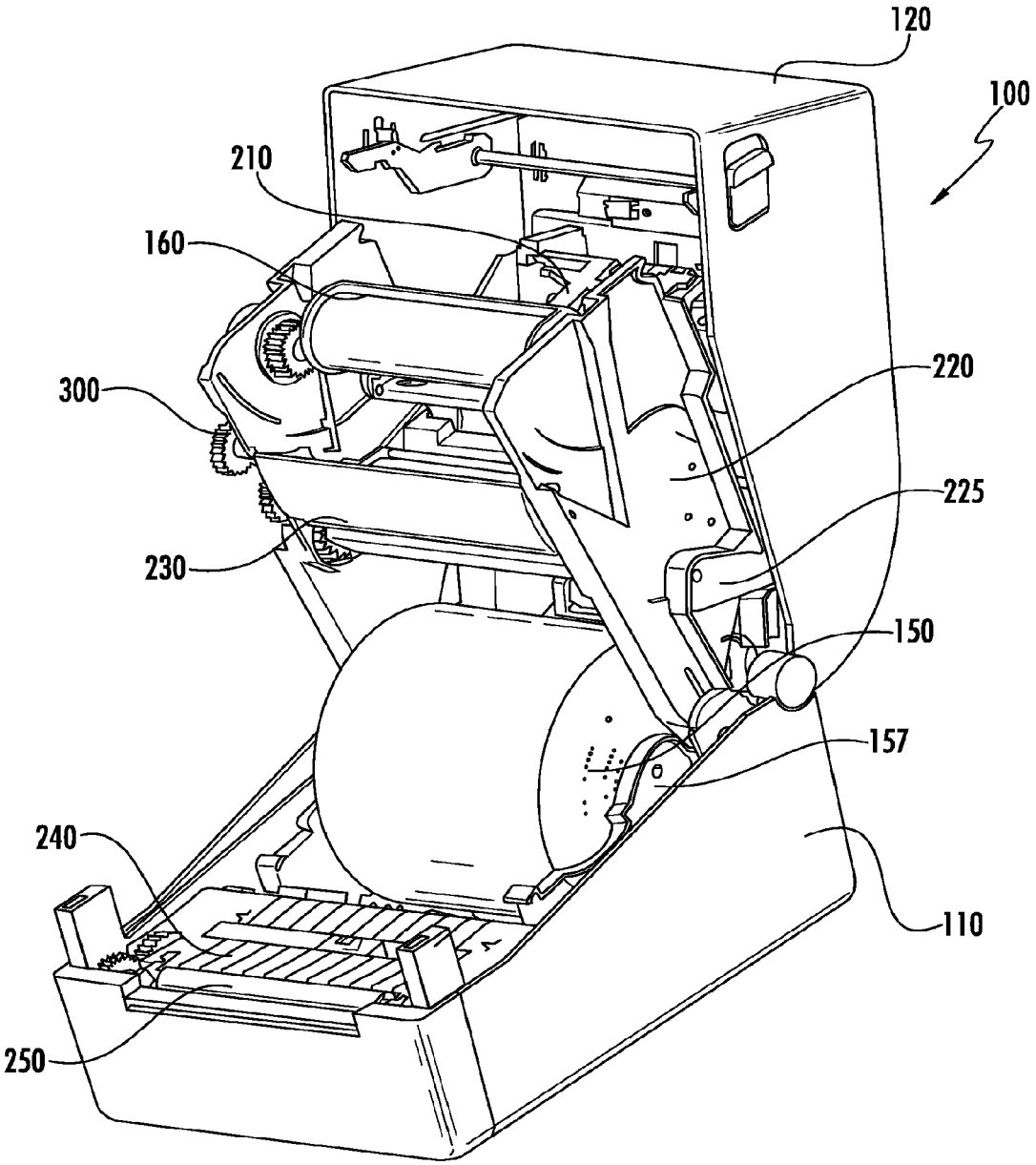
FIG. 3 illustrates a printer with a lid in an open position and a ribbon positioning assembly in an accessible position according to an example embodiment of the present invention.

FIG. 3 illustrates an example embodiment of the present invention with the lid 120 of the printer 100 disposed in the open position. As shown, the lid 120 in the open position is opened to around 100 degrees relative to the base 110, and in some cases, may open beyond 100 degrees relative to the surface on which the base 110 is situated. The lid 120 may be biased toward the open position by, for example, a torsion spring disposed proximate the hinge 130. The ribbon positioning assembly 220 may be connected to the lid 120, for example, by linkage 225, such that the ribbon positioning assembly 220 is moved to an accessible position (as shown in FIG. 3) in response to the lid 120 moving to the open position. The linkage 225 connecting the lid 120 to the ribbon positioning assembly 220 may allow the lid to open to an angle of around 100 degrees while the ribbon positioning assembly 220 opens to an angle that is somewhat less than that of the lid, such as about 80 degrees relative to the surface on which the base 110 is situated, in order to provide access to the ribbon cartridge 160 within the ribbon positioning assembly. As noted above, according to some embodiments of the invention, the ribbon positioning assembly 220 may not be connected to the lid 120 and may be separately movable to the accessible position when the lid 120 is in the open position; however, embodiments in which the ribbon positioning assembly 220 and the lid 120 are mechanically coupled may allow for simpler, single-step access to a ribbon cartridge in the ribbon positioning assembly 220 and/or access to the media 150 without requiring additional steps.

Embodiments of the present invention may provide a printer that remains stable when the lid 120 is in the open position and the ribbon positioning assembly 220 is moved to the accessible position. The center of gravity of the printer may be low and proximate a mid-point between the front of the printer 100 and the back of the printer when the lid 120 is in the closed position. In the open position, the center of gravity may be shifted toward the back of the printer, but the center of gravity may remain within the middle third of the printer along its length, and the center of gravity may remain low, positioned substantially within a cavity defined by the base 110 and below an upper perimeter edge defined by the base. Positioning the center of gravity within the base 110 may maintain a stable printer balance during loading/unloading of consumables from the printer 100.

In the accessible position, with the lid 120 in the fully opened position, the ribbon positioning assembly 220 may provide access to the ribbon cartridge 160 to allow the ribbon cartridge to be removed from and/or replaced within the ribbon positioning assembly. As will be further detailed below, the ribbon cartridge 160 may include aligning features and the ribbon positioning assembly may include complementary aligning features defined by the first and second side rails 161 of the ribbon cartridge which allow the ribbon cartridge to be received in a repeatable and accurate position within the ribbon positioning assembly, as will be described further below. The slots in the ribbon positioning assembly 220 into which the cartridge slides in provide very accurate positioning controls for the cartridge within a tight tolerance. The hard stop at the end slot of the ribbon positioning assembly 220 give a very reliable position to the cartridge each and every time it is inserted. When the lid 120 is in the open position of FIG. 3, the media supply 150 may be accessible to a user for replacement. A media access gap may be defined between the ribbon positioning assembly 220 and the base 110 when the lid 120 and the ribbon positioning assembly 220 are in the open position. This media access gap may allow a supply of media to be easily placed within the base 110. The media supply 150 may be retained within media supply holder 157 which may include a pair of variably spaced members configured to hold a variety of widths of media supplies. The media supply holders 157 may further be configured with features to hold a spool of media therebetween and to allow rotation of the media spool as the media is fed along a media path (e.g., media path 195 of FIG. 2). The media path may be defined between a first media guide 230, which may be attached to the ribbon positioning assembly 220, and a second media guide 240 which may be connected to the base 110. With one media guide 230 disposed on the ribbon positioning assembly 220 and the other on the base 110, the media feed path 195 may be opened to an accessible position in response to the lid 120 being moved to an open position. Such a feature may allow media to be easily received within the cavity 140 of the printer 100 and may permit easy initial feeding of the media 150 along the media feed path. This arrangement precludes the conventional "threading" of media through narrow gaps as is conventionally required.

Embodiments of the present invention may further include a platen 250 disposed along the media feed path configured to be engaged by the printhead 200 when the lid 120 is in the closed position. The media and the ribbon are configured to be received between the nip defined between the printhead 200 and the platen 250 as illustrated in FIG. 2. The platen 250 may define a drive roller and the separation between the printhead 200 and the platen 250 resulting from the lid 120 being moved to the open position may further enhance the ease of feeding media along the media feed path 195 and feeding of the ribbon along the ribbon printing path 190.

Figure 4:
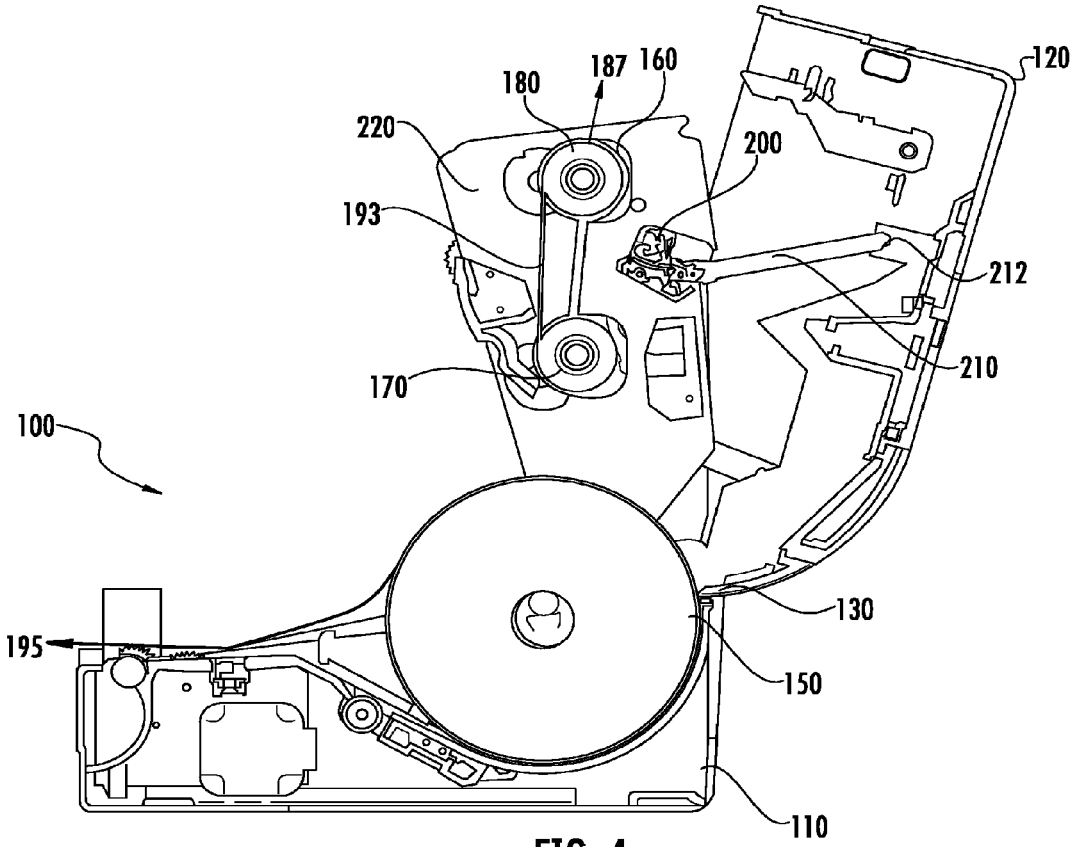
FIG. 4 illustrates a cross-section view of a media processing device in the open position according to an example embodiment of the present invention.

In order to facilitate loading and unloading of the ribbon cartridge 160 into the ribbon positioning assembly 220, the printhead 200 may be disengaged from the ribbon 193 and the ribbon cartridge 160 in response to the lid 120 being moved to the open position, and the ribbon positioning assembly 220 being moved to the accessible position. FIG. 4 illustrates a cross-section view of printer 100 of example embodiments with the lid 120 disposed in an open position relative to the base 110. As shown, the printhead 200 is withdrawn from between the first spool 170 and the second spool 180. The ribbon 193 may be held in tension between the first spool 170 and the second spool 180 when the ribbon positioning assembly 220 is in the accessible position through a tensioning mechanism 300 described further below and shown in FIG. 3.

As illustrated, while the lid 120 is in the open position relative to the base 110, and the ribbon positioning assembly 220 is in the accessible position as illustrated in FIG. 4, the ribbon cartridge 160 may be easily removed from the ribbon positioning assembly 220 by sliding the ribbon cartridge 160 along the direction of arrow 187. In some embodiments, a latch or detent mechanism may retain the ribbon cartridge 160 within the ribbon positioning assembly 220 such that the latch or detent mechanism may need to be disengaged before removing the ribbon cartridge 160. Such a latch or detent mechanism may serve to align the ribbon cartridge 160 in the printer 100 and preclude the ribbon cartridge 160 from shifting during printing or during movement of the printer 100. For example, the ribbon cartridge 160 may include a raised projection configured to be received within a corresponding recess of the ribbon positioning assembly 220. The raised projection may be positioned such that as the ribbon cartridge 160 is inserted into the ribbon position assembly 220, the projection is deflected to enable the projection to be received within the corresponding recess. Once the projection is engaged with the recess, the ribbon cartridge 160 may be more securely held within the ribbon position assembly.

Figure 5:
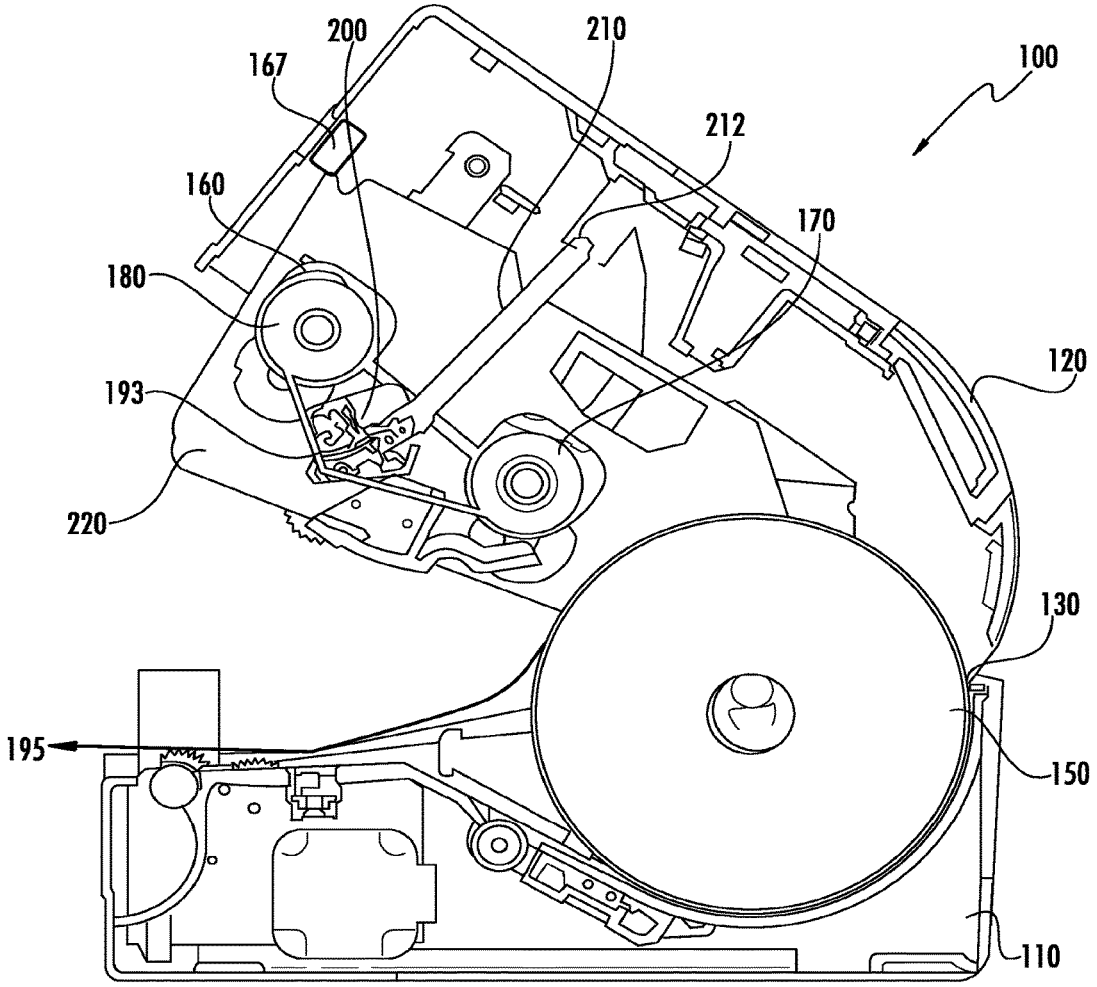
FIG. 5 illustrates a cross-section view of the media processing device of FIG. 4 with the lid between the open position and the closed position.

FIG. 5 illustrates a cross-section view of the printer 100 of FIG. 4 with the lid 120 being advanced toward the closed position relative to the base 110. As illustrated, the lid 120 is disposed at about a 45-degree angle relative to the base and the ribbon cartridge 160 is no longer accessible to a user. As the lid 120 is closed relative to the base 110, the ribbon positioning assembly 220 is moved toward the inaccessible, printing position. Further, as the lid 120 is closed to the base 110, the printhead assembly 210 drives the printhead 200 between the first spool 170 and the second spool 180 of the ribbon cartridge 160 to engage the ribbon 193 which is deflected from the taught, straight ribbon path that the ribbon 193 was in when the lid 120 was in the open position and the ribbon positioning assembly 220 was in the accessible position. The axis of rotation of the first spool 170 and the axis of rotation of the second spool 180 (each such axis of rotation is shown for illustration purposes in FIG. 10) may combine to define a plane (also shown in FIG. 10) between them through which the printhead 200 is driven by the printhead assembly 210 as the lid 120 is closed relative to the base 110. The printhead assembly 210 may be pivotably mounted to the lid 120 at point 212 such that the angle of the printhead assembly 210 changes with respect to the lid 120 as the lid is moved from the open position of FIG. 4 toward the closed position.

The ribbon positioning assembly 220 includes various positioning features that ensure proper alignment between components of the printer. The ribbon positioning assembly 220 includes first and second sidewalls (described further below), that are structured to receive and support the ribbon cartridge 160. The first and second sidewalls may be joined together by structural support members that rigidly tie together the sidewalls to create a ribbon receiving cavity between the sidewalls. The media guide 230 may serve as one of the structural supports that ties the sidewalls together.

Figure 6:
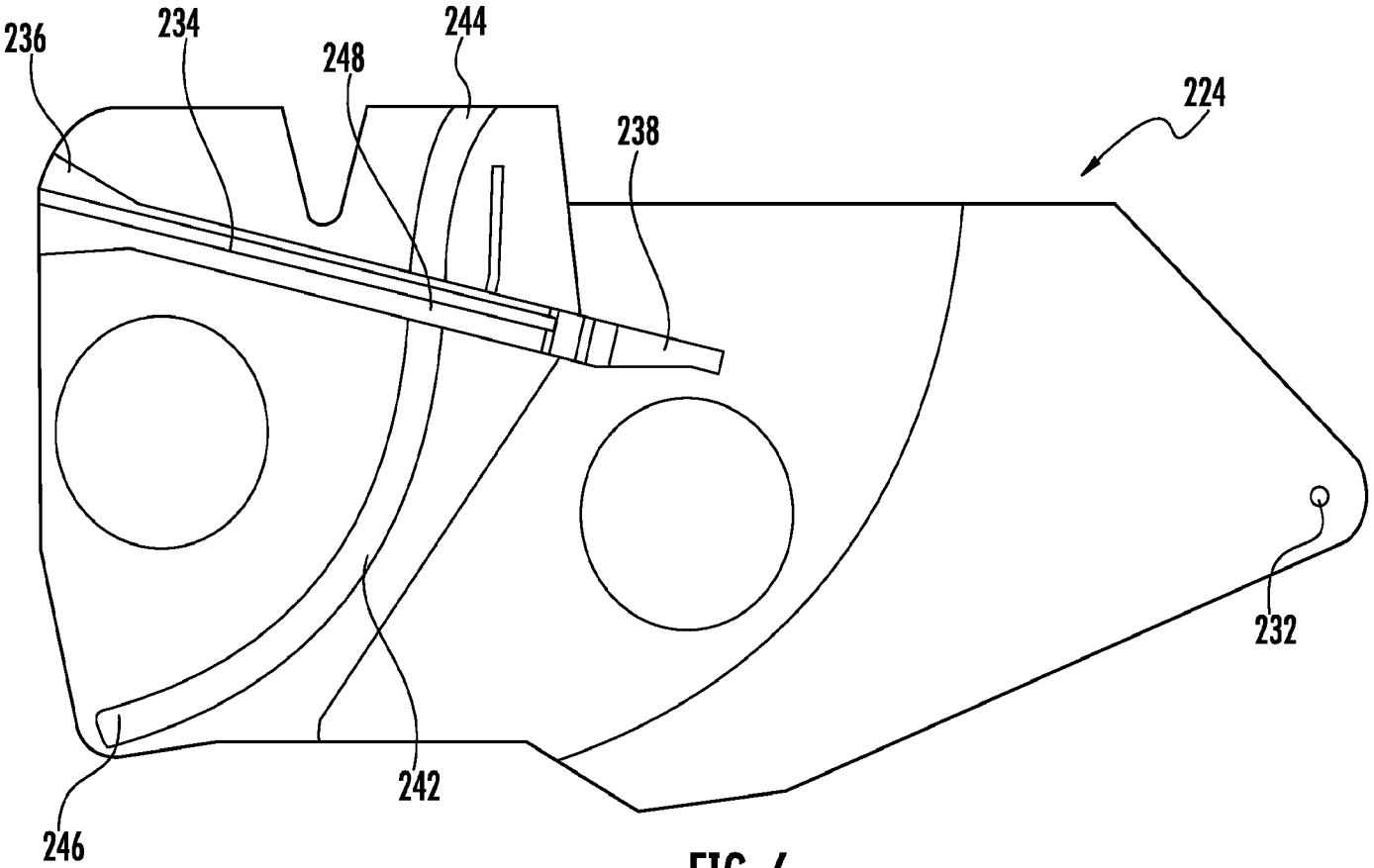
FIG. 6 illustrates a sidewall of a ribbon positioning assembly according to an example embodiment of the present invention.

Further, the ribbon positioning assembly 220 may include guides that direct the movement of components when the lid 120 is moved between the open position and the closed position. FIG. 6 illustrates a sidewall 224 of the ribbon positioning assembly 220 of FIGS. 4-8 as separated from the remaining components of the printer 100. The ribbon positioning assembly 220 may include two sidewalls, one disposed on either side of the ribbon cartridge 160, and both secured together by one or more cross-members (not shown). FIG. 6 illustrates the sidewall 224 as viewed from the ribbon cartridge 160 engaging side of the assembly (i.e., a viewpoint between the two sidewalls). The ribbon positioning assembly 220 may be hinged proximate a hinge point 232 of each of the sidewalls to allow the ribbon positioning assembly 220 to pivot between the printing position and the accessible position. The hinge point 232 may be hinged at the same location as the lid 120 is hinged 130; however, the hinge point 232 may also be hinged at a separate location to the base 110. As noted above, the lid 120 may be attached to the ribbon positioning assembly 220 by linkage 225 to enable movement of the ribbon positioning assembly in concert with the lid.

Figure 7:
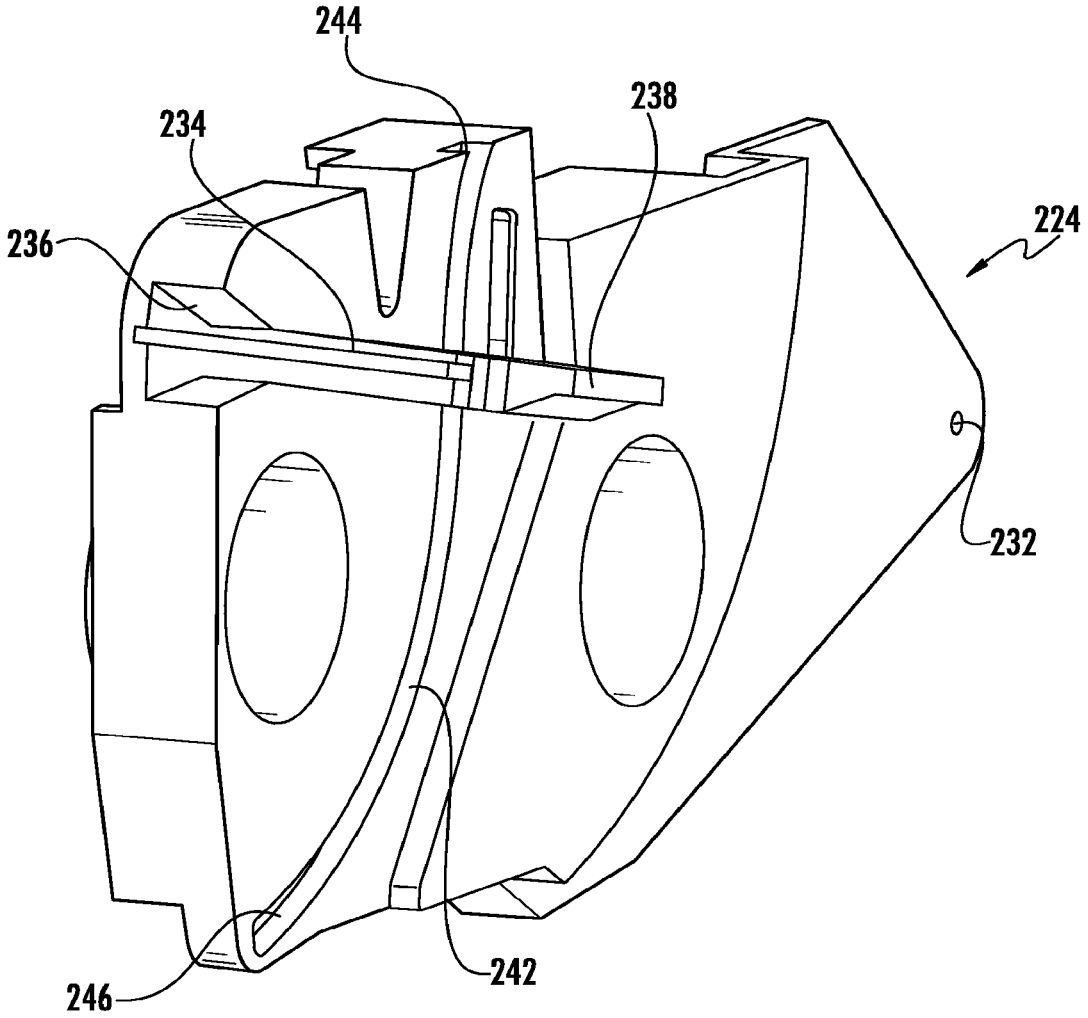
FIG. 7 illustrates a perspective view of the sidewall of FIG. 6.

According to the illustrated embodiment of FIG. 6, the sidewall 224 may include a ribbon receiving channel 234 configured to receive therein a portion of the cartridge 160. As outlined above, the ribbon cartridge 160 may be received within the ribbon position assembly 220 along a direction opposite to that of arrow 187 of FIG. 4. The ribbon cartridge 160 may include a frame with side rails 161 (illustrated further in FIGS. 9 and 10), configured to engage the ribbon receiving channel 234. The insertion end 236 of the ribbon receiving channel 234 may be wider than the ribbon receiving channel in order to allow a ribbon frame to be received at the insertion end 236 and guided into the ribbon receiving channel 234. The ribbon receiving channel 234 may also be configured with alignment features, such as a unique profile, that allows only ribbon cartridges with ribbon frames of a complementary profile to be received within the ribbon receiving channel. FIG. 7 illustrates a perspective view of the sidewall 224 of FIG. 6, better illustrating the profile of the ribbon receiving channel 234. Further, the ribbon receiving channel 234 may be of a specific length and may include a channel end feature 238, such as a taper, which may be in one or more dimensions, or a keyway to allow only those ribbon cartridge frames with the corresponding taper or key to be fully received within the ribbon receiving channel 234. Ribbon cartridges 160 without the appropriate ribbon cartridge side rails 161 may not properly seat within the channel 234 and therefore may not be usable with the ribbon position assembly 220.

Figure 10:
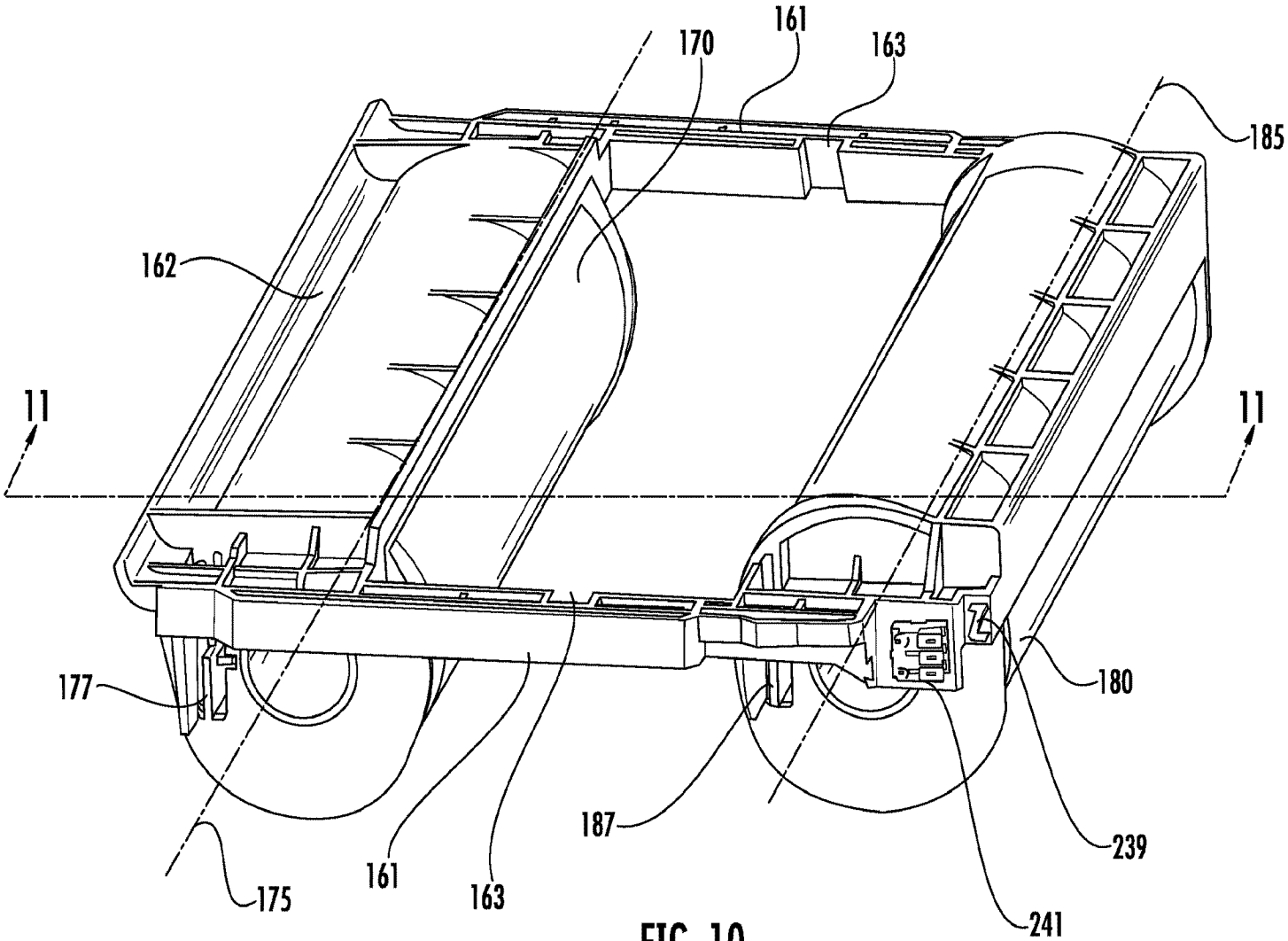
FIG. 10 illustrates a detail view of the spool lock mechanism according to an example embodiment of the present invention.

A corresponding key, such as projection 239 of FIG. 10, may be configured to engage a correspondingly shaped recess of the channel 234 in order to ensure that appropriate ribbon cartridges 160 are used with the printer. Further, according to some embodiments of the present invention, the sidewall 224 of the ribbon positioning assembly may be configured with a radio frequency identification reader configured to read a radio frequency identification tag 241 of a ribbon cartridge received therein. FIG. 10 illustrates an example embodiment of the RFID tag 241. The tag 241 may be configured to store information related to the cartridge, such as printer settings (print speed, head temperature, etc.), ribbon type, ribbon serial number, usage statistics, etc. This information may be written to or read from the RFID tag by various components within the printer. Further, the printer may be configured to print only in response to the RFID tag 241 of the ribbon cartridge corresponding to a specific type of ribbon.

Figure 13:
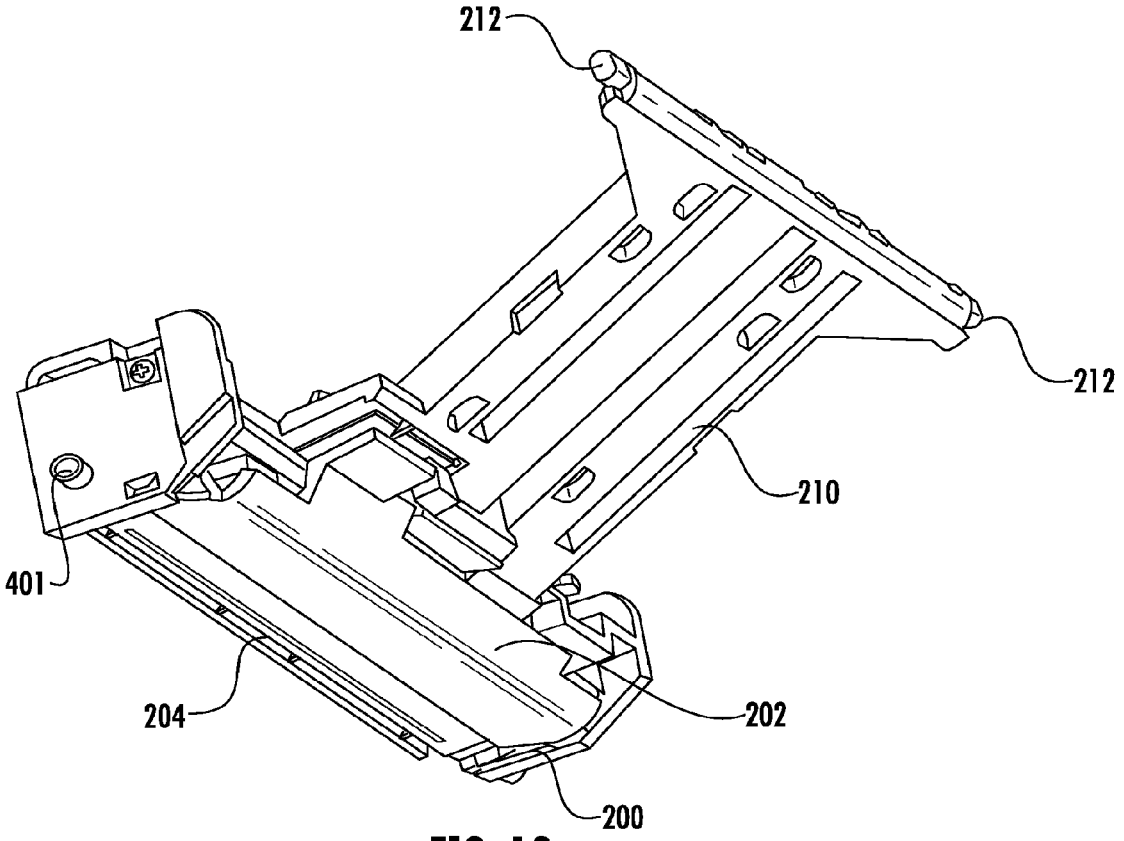
FIG. 13 illustrates a printhead assembly having a deflector configured to reduce ribbon wrinkle according to example embodiments of the present invention.

Referring back to FIG. 7, the ribbon position assembly 220 sidewall 224 may further include a printhead assembly channel 242 to guide the printhead assembly 210 as the printhead 200 is driven between the first spool 170 and the second spool 180 of the ribbon cartridge 160. The printhead assembly 210 may include projections 401 extending from either end of the longitudinally extending printhead 200 as illustrated in FIG. 13. These projections may engage the channel 242 to guide the printhead assembly 210 along a predefined path when the lid 120 of the printer 100 is moved between the open and closed positions. As the lid 120 is closed relative to the base 110, the printhead assembly 210 is driven along channel 242 from the top of the channel 244 to the bottom of the channel 246, whereupon the printhead 200 is in the engaged, printing position.

As illustrated in FIG. 6, the printhead assembly guide channel 242 crosses the ribbon cartridge guide channel 234 at 248, as the printhead assembly 210 is guided through the ribbon cartridge 160 when the lid 120 is closed. The ribbon cartridge frame side rails 161 may include a recess 163 proximate the location 248 where the channels cross when the ribbon cartridge 160 is in the installed position. This recess 163, as shown in FIGS. 10 and 10A 163 allows the projections of the printhead assembly 210 to pass through the cartridge 160 as the printhead assembly 210 is guided along the printhead assembly guide channel 242. A ribbon cartridge 160 lacking this feature may preclude the lid 120 from being closed as the printhead assembly 210 may be prevented from passing between the first spool 170 and the second spool 180.

Figure 8:
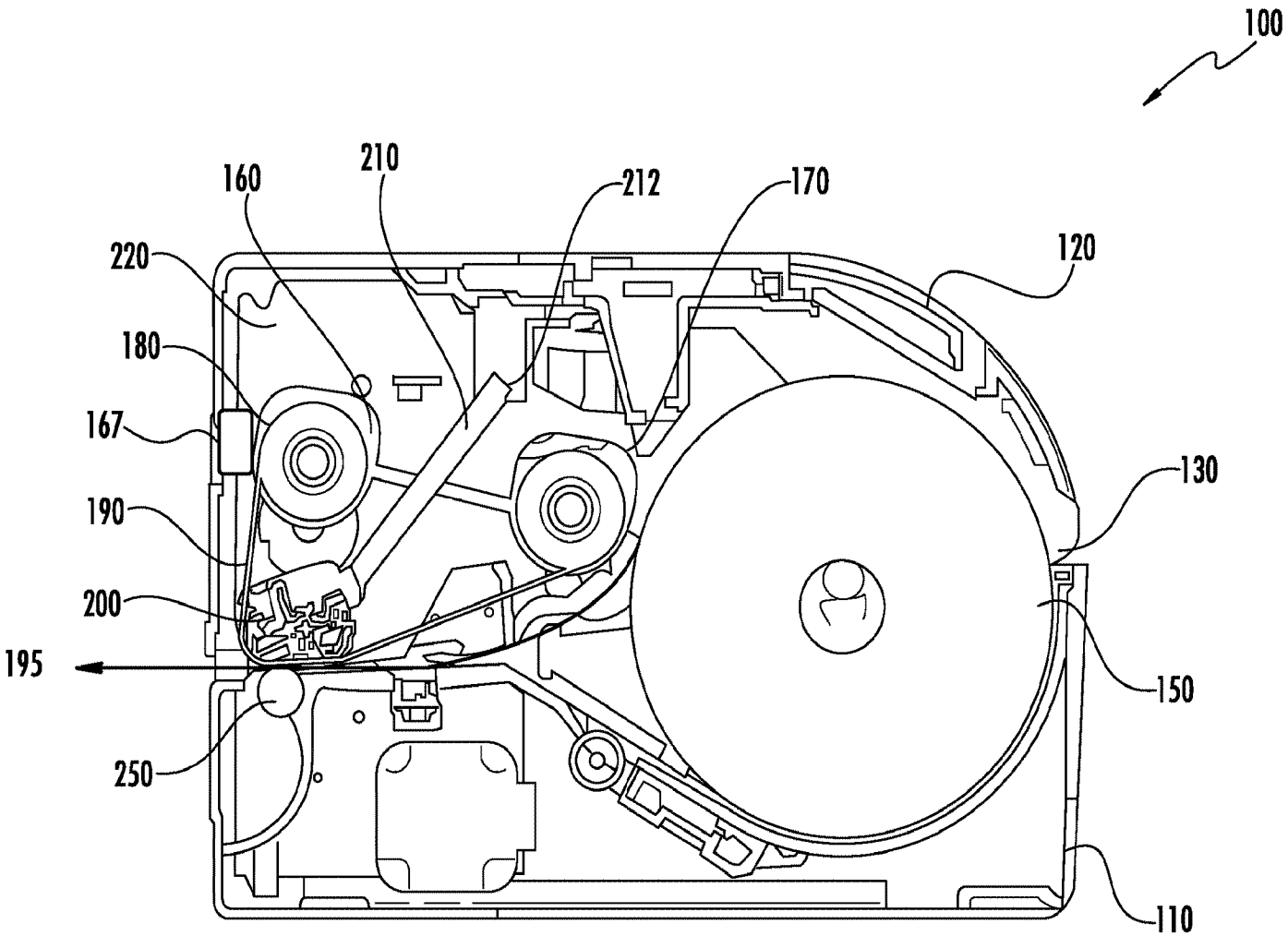
FIG. 8 illustrates a cross-section view of the media processing device of FIGS. 4 and 5 with the lid in the closed position relative to the base.

Referring back to FIG. 5, as the lid 120 is closed further toward the closed position relative to the base 110, the printhead 200 is further driven between the first spool 170 and the second spool 180 of the cartridge 160 until the lid 120 is closed relative to the base 110 as shown in FIG. 8. As shown, the printhead 200 has been driven through the imaginary plane defined between the axes of rotation (175 and 185 of FIG. 10) of the first spool 170 and the second spool 180 along the path defined by the printhead assembly guide channel 242. Further, as the lid 120 was closed the printhead 200 was guided between the first spool 170 and the second spool 180 of the ribbon cartridge 160, forward in the printer toward the second spool 180, which may be, for example, a take-up spool. This movement of the printhead 200 through the print cartridge 160 and toward a front side of the printer 100 may be facilitated by the pivotable mounting of the printhead assembly 210 to the lid 120 which allows the angle of the printhead assembly 210 to change relative to the lid 120 and the base 110 as the printer lid 120 is moved to the closed position and the printhead assembly 210 is guided along the printhead assembly guide channels 242 illustrated in FIGS. 6 and 7.

The lid 110 may further include one or more projections 167 disposed inside the lid configured to engage the ribbon cartridge 160 upon the lid being moved to the closed position. The one or more projections 167 may be configured to ensure the ribbon cartridge 160 is fully seated in the ribbon cartridge guide channel 234, thereby ensuring that the ribbon cartridge spools are properly engaged with the ribbon drive gears described further below. The one or more projections 167 may also preclude movement of the ribbon cartridge 160 during movement of the printer 100 by precluding any fore/aft movement of the ribbon cartridge 160, supplementing the security provided by the detent engagement of the printhead 160 within the printhead positioning assembly 220. The one or more projections 167 further ensure that the appropriate ribbon cartridge 160 is used. If a ribbon cartridge 160 cannot be properly seated within the ribbon cartridge guide channel 234, the projection 167 will preclude the lid 120 from closing properly, and prevent operation of the printer 100.

In the example embodiment described above with respect to FIGS. 4-8, the printhead 200 is moved with respect to the ribbon cartridge 160, through the ribbon cartridge 160 through a first plane defined between the axis of rotation 175 of the first spool 170 and the axis of rotation 185 of the second spool 180, and toward a second plane defined through the axis of rotation 185 of the second spool 180 and perpendicular to the first plane. In this manner, the printhead passes between the first spool 170 and the second spool 180, and becomes engaged with the ribbon along the ribbon printing path 190 (which is the position of the ribbon 193 of FIGS. 4 and 5 when the ribbon 193 is captured between the printhead 200 and the platen 250). The printhead 200 in the printing position of FIG. 8 is disposed between the platen roller 250 and the second spool 180.

The mechanism by which the printhead is advanced between the first spool 170 and the second spool 180 and advanced to the printing position of FIG. 8, including the printhead assembly 210 pivotably coupled to the lid 120 and the printhead assembly guide channel 242, may provide advantages for printer design by allowing the printer components to be arranged in a more compact housing. For example, positioning the printhead 200 and the platen roller 250, which define a print region therebetween that includes the ribbon path 190 and the media feed path 195, toward the front of the printer 100 enables the media drive components to be positioned between the print region and the media 150. Separating the print area from the moving components of the media drive components may reduce vibration at the print region and may increase print quality. Further, positioning the printhead 200 between the platen roller 250 and the second spool 180 enables the second spool 180 and the printhead 200 to be located proximate the front of the printer 100 as opposed to having the printhead 200 set back from the front of the printer 100 to accommodate a ribbon spool between the printhead and the front of the printer.

When the consumables of the printer 100, such as the ribbon cartridge 160 or the media 150, need to be replaced, the lid 120 of the printer needs to be moved to from the closed, printing position of FIG. 8 to the open position of FIG. 4. In order to open the lid 120, a user may release a latching mechanism that secures the lid 120 to the base 110. The latching mechanism may be a retaining hook or tab (not shown) disposed on either the lid 120 or the base 110 and engages a complementary recess on the other of the lid 120 or the base 110. The latching mechanism may be released by the press of a button which may disengage the tab from the corresponding recess, and allow the lid 120 to be moved to the open position relative to the base 110. As noted above, the lid 120 may include a spring or biasing mechanism, such as a torsion spring disposed proximate the hinge 130 to bias the lid 120 toward the open position. The biasing mechanism may, in some embodiments, be configured to move the lid 120 the closed position to the open position in response to the latching mechanism being disengaged. However, in other embodiments, the biasing mechanism may provide assistance to a user to lift the lid 120 to the open position. In example embodiments in which the biasing mechanism includes sufficient biasing force to lift the lid 120 to the open position, a user may open the printer 100 and obtain access to the cavity and consumable components with only a press of a button to release the latching mechanism. This may facilitate one-handed operation which may be beneficial if the user only has one hand free, such as when they are holding the replaceable consumables.

In response to the lid 120 being moved from the closed position to the open position, the printhead 200 becomes disengaged from the ribbon 193 and is moved out from between the first spool 170 and the second spool 180 of the cartridge 160, along the printhead assembly guide channel 242 from the bottom 246 to the top 244. In this manner, undesirable slack in the ribbon 193 may remain, such as when the length of ribbon exposed between the first spool 170 and the second spool 180 is sufficient for the length of ribbon printing path 190, but is not necessary when the printhead 200 is disengaged from the ribbon 193, leaving excess ribbon between the first spool 170 and the second spool 180. As such, it may be desirable to remove the slack from the ribbon 193 when the lid 120 is moved to the open position, the ribbon positioning frame 220 is moved to the accessible position, and the printhead 200 is disengaged from the ribbon 193.

Figure 9:
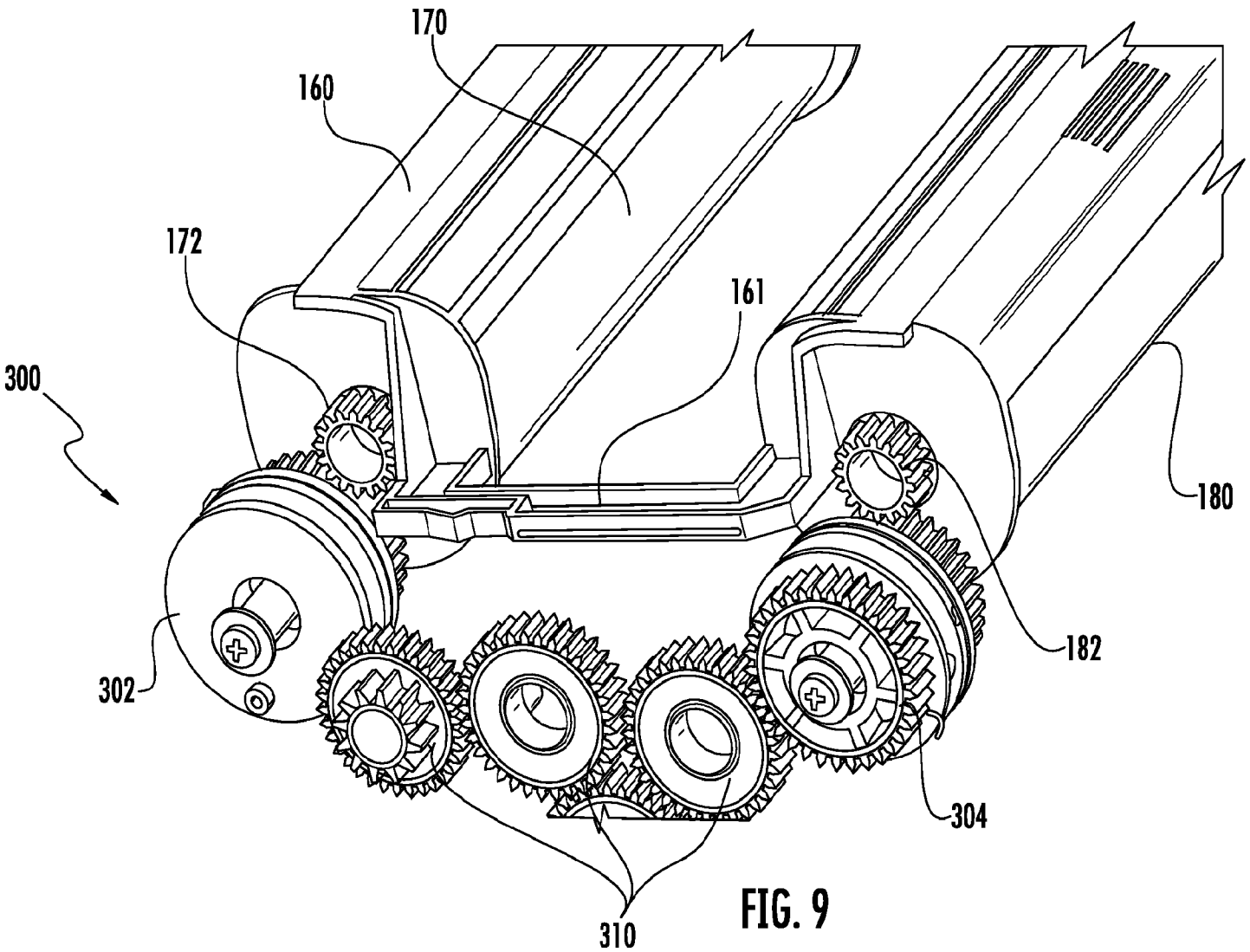
FIG. 9 illustrates a detail view of the ribbon tension mechanism and the ribbon driving gear train according to an example embodiment of the present invention.

Embodiments of the present invention may include a ribbon tensioning mechanism 300 as visible in FIG. 3 and shown in detail in FIG. 9. During printing, when the lid 120 is in the closed position and the ribbon positioning assembly 220 is in the inaccessible, printing position, one or both of the first spool 170 and the second spool 180 are driven to advance the ribbon 193 from the supply spool to the take-up spool as printing occurs. In the illustrated embodiment, both the first spool 170 and the second spool 180 are driven. A gear train including gears 310 may be driven by a pinion gear coupled to a drive assembly in the base 110 of the printer 100. In response to the pinion gear driving the gears 310 of the gear train, the gear 172 of the first spool 170 and the gear 182 of the second spool 180 may be driven, through tensioning mechanisms 302 and 304.

Tensioning mechanisms 302 and 304 may each include a driven gear that is coupled to the gears 310 of the gear train and a drive gear that is coupled to a respective one of the gears 172, 182 of the first spool 170 and the second spool 180. Between the driven gear and the drive gear of each tensioning mechanism 302, 304 may be a torsion spring and a clutch. In this manner, as the pinion gear drives gears 310 of the gear train, the driven gears of the tensioning mechanism are driven. The torsion spring of each tension mechanism 302, 304 is wound until a threshold force is achieved, at which time force is transmitted across the clutch of each tension mechanism 302, 304 to the drive gear of each tension mechanism, which drives the gears 172, 182 of the ribbon spools. During the process of printing, the torsion springs within the first and second tension mechanisms 302, 304, start to wind up and reach a maximum tension. This mechanism pre-loads the torsion springs of the tension mechanisms 302, 304 during printing and holds that pre-loaded torsion force during printing. While the illustrated embodiments include a ribbon cartridge, the tension mechanisms may also be used for a non-cartridge ribbon embodiment, such as with independent ribbon spools. The tension mechanisms help to minimize wrinkling of the ribbon which can lead to reduced print quality as the tension mechanisms apply tension during printing, while the tension mechanisms 302, 304 are preloaded, and maintain tension on the ribbon to keep the ribbon from folding over on itself when the printhead is disengaged from the ribbon.

In response to a user releasing a latching mechanism and opening the lid 120 of the printer 100 from the closed position to the open position, and the ribbon positioning assembly 220 is moved from the inaccessible, printing position to the accessible position, as shown in FIG. 4, the pinion gear of the drive assembly of the base 110 is disengaged from the gears 310 of the gear train. As the printhead 200 is disengaged from the ribbon 193, the slack in the ribbon is taken up by the unwinding of the first spool 170 and the second spool 180 caused by the torsion springs within tensioning mechanisms 302 and 304. As such, when the lid 120 of the printer 100 is opened, the ribbon 193 returns to be taught between the first spool 170 and the second spool 180, as illustrated in FIG. 4.

As described above, tension across the ribbon 193 between the first spool 170 and the second spool 180 is facilitated by the tensioning mechanisms 302 and 304. The tensioning mechanisms are engaged with the gears 172, 182 while the ribbon cartridge 160 is received within the ribbon positioning assembly 220. In order to maintain tension on the ribbon 193 between the first spool 170 and the second spool 180 when the ribbon cartridge is removed from the ribbon positioning assembly 220, another mechanism may be necessary.

According to embodiments of the present invention, as illustrated in FIG. 10, a ribbon cartridge 160 is provided which features a spool lock feature configured to prevent rotation of at least one of the first spool 170 and the second spool 180. The ribbon cartridge, as illustrated in FIG. 10, is viewed from the opposite side from which the spools are driven by the gears 310. A first spool lock feature 177 and a second spool lock feature 187 are each configured to engage a gear of a respective spool. According to the illustrated embodiment, the gear of each spool that is engaged by the spool lock features 177, 187 is contained within the cartridge housing 162. The gears, which may be a series of teeth disposed about the hub of a respective spool 170, 180, are configured to be engaged by a respective spool lock feature 177, 187. The spool lock features 177, 187 of the illustrated embodiment include a flexible pawl extending from the housing 162 including one or more gear teeth configured to engage the complementary teeth of the spool hub. A portion of the pawl extends through the housing between the exterior of the housing, and an interior of the housing where the gear teeth of the pawl engage the gear teeth of the spool hub. The pawls of the spool lock features 177, 187 are biased into engagement with their respective spools such that rotation of the spools 170, 180, is prevented when the ribbon cartridge 160 is not loaded into a printer. In response to the ribbon cartridge 160 being loaded into a printer, such as into ribbon receiving channels 234 of the ribbon positioning assembly 220, the portion of the spool lock features 177, 187 extending outside of the cartridge housing 162 may engage stationary features which drive the flexible pawls of the spool lock features out of engagement with the spool hubs as the ribbon cartridge is seated in position within the ribbon positioning assembly 220. These stationary features may be projections disposed on a sidewall 224 of the ribbon positioning assembly 220.

Figure 11:
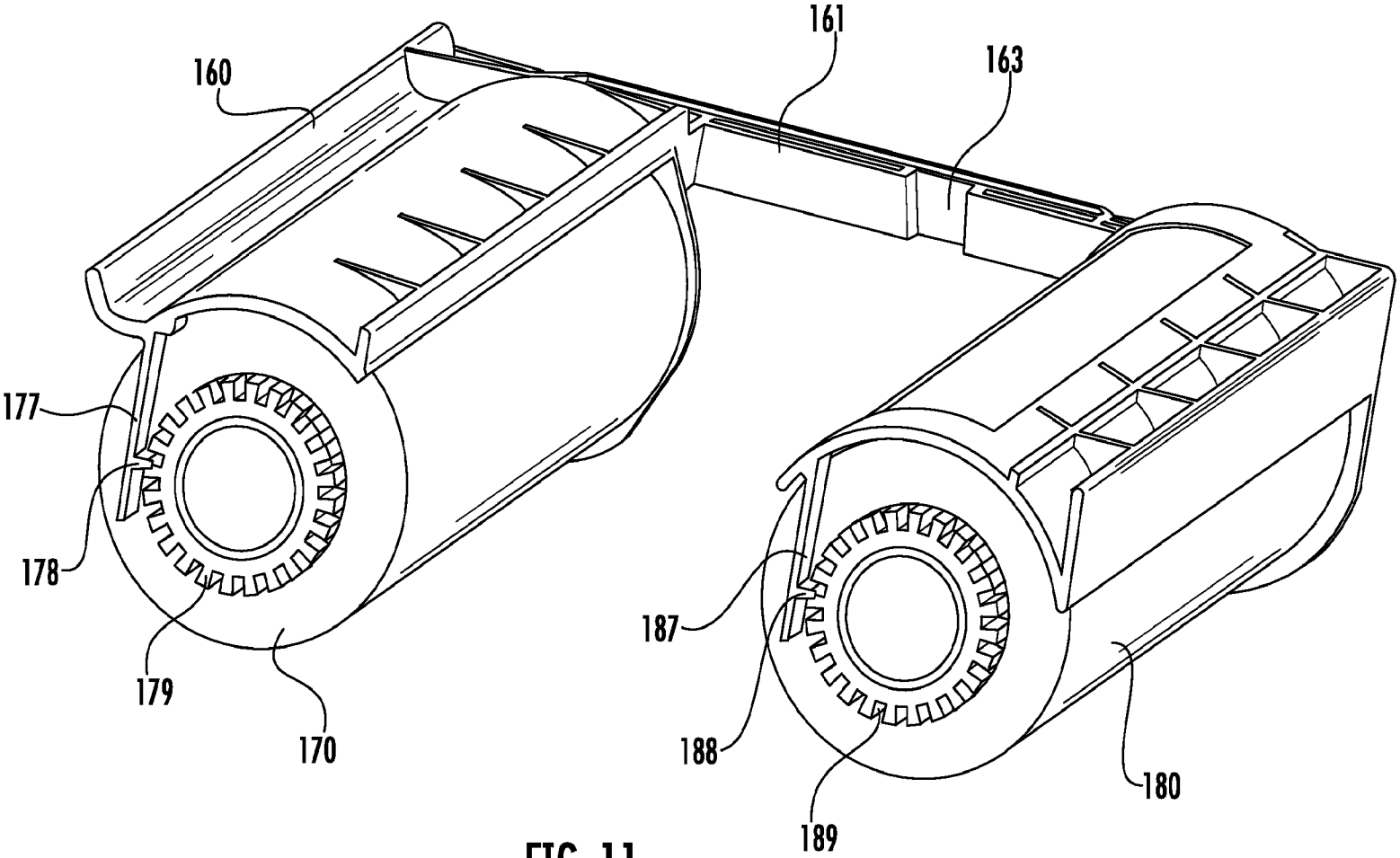
FIG. 11 illustrates a cross-section view of the spool lock mechanism of FIG. 10 taken along section line 11-11.

FIG. 11 illustrates a cross-section view of the ribbon cartridge 160 of FIG. 10, taken along section line 11-11 of FIG. 10. As illustrated, the spool lock features 177, 187, are flexible pawls including one or more gear teeth 178, 188 extending therefrom. Each of the spools 170, 180, include a series of teeth 179, 189, disposed about a respective hub, that are engaged by the spool locking features.

Figure 12:
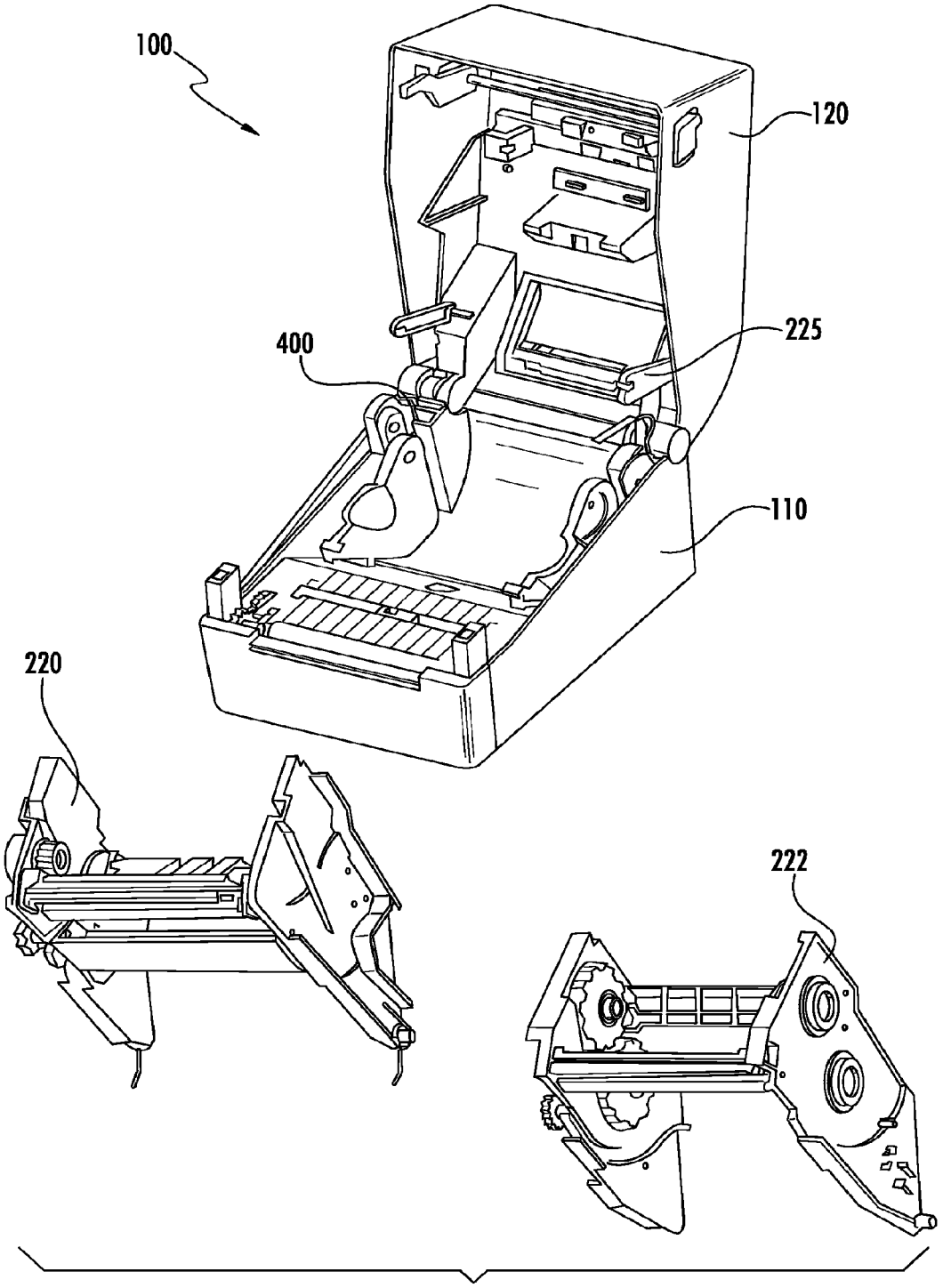
FIG. 12 illustrates a media processing device including two interchangeable ribbon positioning assemblies according to an example embodiment of the present invention.

While the above disclosed embodiments describe a ribbon positioning assembly 220 that is configured to receive a ribbon cartridge therein, embodiments of the invention may further be configured with ribbon positioning assemblies that are configured to receive loose ribbon spools that do not include a cartridge. In this manner, a second ribbon positioning assembly 222 may be interchangeable with the ribbon positioning assembly 220 configured to receive a ribbon cartridge, as illustrated in FIG. 12. The printer 100 may be configured to interchangeably receive the ribbon positioning assembly 220 for a ribbon cartridge 160 and the ribbon positioning assembly 222 for ribbon spools. The ribbon positioning assemblies may attach at the pivot point 400 and linkage 225 such that the ribbon positioning assembly that is installed moves with the lid 120 between the inaccessible, printing position when the lid 120 is in the closed position, and the accessible position when the lid 120 is in the open position.

FIG. 13 illustrates a printhead 200 and printhead assembly 210 according to an example embodiment of the invention. The printhead assembly, as described above, may pivot relative to the lid 120. This may be accomplished by pivoting mounts, such as pins 212 received within corresponding holes of the lid 120. The printhead 210 may include an anti-wrinkle feature to help improve print quality by stretching the ribbon 193 and removing wrinkles from the ribbon 193 as they approach the print line 204 of the printhead 200. The anti-wrinkle feature may include a deflector assembly 202 disposed immediately upstream of the print line 204 relative to the media and ribbon feed paths. The deflector assembly may include a convex curvature to stretch the ribbon 193 across the deflector 202 ahead of the print line 204. This may reduce wrinkles in the ribbon 193 at the print line 204 and reduce the amount of printhead force generally used to eliminate ribbon wrinkles at the print line. This deflector 202 may thus allow for less force and less structure necessary in the printhead assembly 210 to achieve an equivalent or superior print quality to comparable printheads.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A printer comprising:

a base;

a lid hingedly attached to the base movable between a closed position in which the lid is secured to the base, and an open position in which the lid is at least partially separated from the base;

a cavity defined between the lid and the base, wherein the cavity is inaccessible when the lid is in the closed position and the cavity is accessible when the lid is in the open position;

a ribbon positioning assembly disposed within the cavity that is pivotably attached to at least one of the lid or the base wherein the ribbon positioning assembly is configured to move between a printing position when the lid is in the closed position, and an accessible position when the lid is in the open position, wherein the ribbon positioning assembly comprises a ribbon tensioning mechanism, wherein the ribbon positioning assembly is configured to receive therein a ribbon cartridge comprising a first spool and a second spool, with a ribbon extending therebetween; and a printhead assembly pivotably coupled to the lid, wherein in response to the lid being moved from the open position to the closed position, the printhead assembly is driven between the first spool and the second spool, wherein the printhead assembly comprises a printhead, and wherein in response to the lid moving from the open position to the closed position, the printhead moves to a position in which the second spool is positioned substantially between the printhead and the lid.

2. The printer of claim 1, wherein the ribbon tensioning mechanism is configured to apply tension to the ribbon between the first spool and the second spool.

3. The printer of claim 2, wherein the ribbon tensioning mechanism is configured to maintain tension on the ribbon in response to the lid being moved from the closed position to the open position.

4. The printer of claim 3, wherein the printhead of the printhead assembly is disengaged from the ribbon in response to the lid being moved from the closed position to the open position.

5. The printer of claim 4, wherein the printhead of the printhead assembly is engaged with the ribbon in response to the lid being moved from the open position to the closed position.

6. The printer of claim 5, wherein the printhead assembly is disposed at a first angle relative to the lid in response to the lid being in an open position, and wherein the printhead assembly is disposed at a second angle relative to the lid, different from the first angle, in response to the lid being in a closed position.

7. The printer of claim 1, wherein the printhead assembly further comprises a convex deflector assembly and defines a print line where the printhead engages a platen roller, wherein the convex deflector assembly is positioned upstream of the print line relative to a media feed path.

8. The printer of claim 7, wherein the convex deflector assembly applies tension across a width of the ribbon, parallel to the print line to remove wrinkles from the ribbon as it moves along a ribbon printing path.

9. The printer of claim 1, wherein the ribbon cartridge includes a frame member extending from a first end to a second end, wherein a first portion of the frame member has a lesser width relative to a second portion of the frame member.

10. The printer of claim 1, wherein the ribbon cartridge includes a radio frequency identification tag disposed proximate the first end.

11. A printer comprising:

a base;

a lid hingedly attached to the base movable between a closed position in which the lid is secured to the base, and an open position in which the lid is at least partially separated from the base;

a cavity defined between the lid and the base, wherein the cavity is inaccessible when the lid is in the closed position and the cavity is accessible when the lid is in the open position;

a ribbon positioning assembly disposed within the cavity that is pivotably attached to at least one of the lid or the base wherein the ribbon positioning assembly is configured to move between a printing position when the lid is in the closed position, and an accessible position when the lid is in the open position, wherein the ribbon positioning assembly comprises a ribbon tensioning mechanism, wherein the ribbon positioning assembly is configured to receive therein a ribbon cartridge comprising:

a first spool and a second spool, with a ribbon extending therebetween; and a frame member extending from a first end to a second end, wherein a first portion of the frame member has a lesser width relative to a second portion of the frame member; and a printhead assembly pivotably coupled to the lid, wherein in response to the lid being moved from the open position to the closed position, the printhead assembly is driven between the first spool and the second spool.

12. A printer comprising:

a base;

a lid hingedly attached to the base movable between a closed position in which the lid is secured to the base, and an open position in which the lid is at least partially separated from the base;

a cavity defined between the lid and the base, wherein the cavity is inaccessible when the lid is in the closed position and the cavity is accessible when the lid is in the open position;

a ribbon positioning assembly disposed within the cavity that is pivotably attached to at least one of the lid or the base wherein the ribbon positioning assembly is configured to move between a printing position when the lid is in the closed position, and an accessible position when the lid is in the open position, wherein the ribbon positioning assembly comprises a ribbon tensioning mechanism, wherein the ribbon positioning assembly is configured to receive therein a ribbon cartridge comprising:

a first spool and a second spool, with a ribbon extending therebetween; and a radio frequency identification tag disposed proximate a first end; and a printhead assembly pivotably coupled to the lid, wherein in response to the lid being moved from the open position to the closed position, the printhead assembly is driven between the first spool and the second spool.

* * * * *